US009551100B2

(12) United States Patent
Van Herpen

(10) Patent No.: US 9,551,100 B2
(45) Date of Patent: Jan. 24, 2017

(54) DUST MITE KILLING CARPET

(75) Inventor: Maarten Marinus Johannes Wilhelmus Van Herpen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 658 days.

(21) Appl. No.: 13/000,409

(22) PCT Filed: Jun. 30, 2009

(86) PCT No.: PCT/IB2009/052824
§ 371 (c)(1),
(2), (4) Date: Dec. 21, 2010

(87) PCT Pub. No.: WO2010/001332
PCT Pub. Date: Jan. 7, 2010

(65) Prior Publication Data

US 2011/0110091 A1 May 12, 2011

(30) Foreign Application Priority Data

Jul. 3, 2008 (EP) ..... 08159617
Jul. 30, 2008 (EP) ..... 08161405
Oct. 7, 2008 (EP) ..... 08165973

(51) Int. Cl.
*D05C 17/02* (2006.01)
*F21S 4/00* (2016.01)
*F21V 19/00* (2006.01)

(52) U.S. Cl.
CPC ..... *D05C 17/02* (2013.01); *F21S 4/001* (2013.01); *F21S 4/003* (2013.01); *F21V 19/0005* (2013.01)

(58) Field of Classification Search
CPC ..... F21S 4/001; F21S 4/003; F21V 19/0005
USPC ..... 362/249.14
See application file for complete search history.

(56) References Cited

U.S. PATENT DOCUMENTS 3,755,058 A * 8/1973 Winkler ..... 428/167
4,234,907 A 11/1980 Daniel
4,737,764 A * 4/1988 Harrison ..... 362/153
4,761,047 A * 8/1988 Mori ..... A61N 5/0616 36/137

(Continued)

FOREIGN PATENT DOCUMENTS

DE 4220613 A1 6/1993
DE 102006012606 A1 11/2007

(Continued)

OTHER PUBLICATIONS

CRC Handbook of Chemsitry and Physics, 69th Edition, 1988-1989, pp. E208, E406.

*Primary Examiner* — Jong-Suk (James) Lee
*Assistant Examiner* — Mark Tsidulko

(57) ABSTRACT

A light source carpet includes a light source and a tufted carpet. The tufted carpet includes a primary backing layer having top and bottom faces. The primary backing layer further includes yarns integrated in the primary backing layer with tufts protruding from the primary backing layer at the top face, where the tufts form a carpet top face. The light source is configured to illuminate the primary backing layer. The intensity of the light at the carpet top face is smaller than the intensity of the light at the top face. The light source is further configured to generate light having a wavelength in the range of 200-400 nm.

16 Claims, 4 Drawing Sheets

(56) References Cited

U.S. PATENT DOCUMENTS

| | | | | |
|---|---|---|---|---|
| 4,794,373 | A * | 12/1988 | Harrison | 340/286.01 |
| 6,481,877 | B1 * | 11/2002 | Bello, Jr. | 362/488 |
| 7,461,430 | B2 * | 12/2008 | Reick-Mitrisin et al. | 15/323 |
| 7,476,885 | B2 * | 1/2009 | Garcia | A61L 2/10 15/339 |
| 7,803,446 | B2 * | 9/2010 | Martz | 428/95 |
| 8,109,981 | B2 * | 2/2012 | Gertner et al. | 607/88 |
| 2004/0231056 | A1 | 11/2004 | Jansen | |
| 2007/0037462 | A1 | 2/2007 | Allen et al. | |
| 2008/0113214 | A1 | 5/2008 | Davis et al. | |

FOREIGN PATENT DOCUMENTS

| | | | |
|---|---|---|---|
| EP | 1513186 | A2 | 3/2005 |
| FR | 2911549 | A1 | 7/2008 |
| JP | 02182140 | A | 7/1990 |
| JP | 08056810 | A | 3/1996 |
| JP | 10052480 | A | 2/1998 |
| JP | 2004169362 | A | 6/2004 |
| WO | 2007033980 | A2 | 3/2007 |
| WO | 2007147278 | A2 | 12/2007 |
| WO | 2009066216 | A1 | 5/2009 |

* cited by examiner

DUST MITE KILLING CARPET

FIELD OF THE INVENTION

The present invention relates to a light source carpet construction comprising a light source and a carpet, as well as to a medical application thereof.

BACKGROUND OF THE INVENTION

Carpets generally comprise a primary backing layer provided with yarns forming tufts (on its side facing the user during its use as carpet), a secondary backing layer, and in general an adhesive layer provided between the primary backing layer and the secondary backing layer. The yarns penetrate the primary backing layer to form tufts projecting from the pile surface on which people can walk, etc. The yarns are normally loose and need to be adhered with adhesive (from an adhesive layer). The adhesive layer which may be present on the backside of the primary backing adheres the tufts to the primary backing layer and holds the tufts in place, as well as adhering the primary backing layer and the secondary backing layer. The latter may also be achieved with a second adhesive layer on top of the first adhesive layer.

Textiles comprising optical fibres are known in the art. US2007/0037462 for instance describes a method for manufacturing a distributed optical fibres scrim comprising functional optical fibres, the functional optical fibres scrim thus manufactured, and composites in which an optical fibres scrim is incorporated. This document describes a variety of textile scrims, particularly adhesively bonded non-woven scrim materials, each comprising at least one optical fibre with a continuous path across at least the length or width of the fabric. Such optical fibres scrims may be useful as sensor components (for example, as a detector of breakage, strain, pressure, or torque), as illumination components (for example, in a variety of light-providing applications), or as data-distribution components, either alone or in combination with other materials, such as fabrics, films, foams, and the like.

The use of electronic components in for instance carpets is known in the art. WO2007033980 for instance describes such carpet, as well as a method for equipping a carpet with electronic components. In order to create a method which ensures that the electronic components can be applied to the carpet in an efficient and accurately locatable manner, the electronic components that are fixedly joined to a support material are glued to the carpet with the aid of the supports.

SUMMARY OF THE INVENTION

The house dust mite (sometimes abbreviated by allergists to HDM, and herein also abbreviated as "house mite" or "mite")), is often found in human habitation. Dust mites feed on organic detritus such as flakes of shed human skin and flourish in the stable environment of houses. In nature they are killed by micro-predators and by exposure to direct sun rays. Dust mites are the most common cause of asthma and allergic symptoms worldwide. The European house dust mite (Dermatophagoides pteronyssinus) and the American house dust mite (Dermatophagoides farinae) are two different species, but are not necessarily confined to Europe or North America. Mites thrive in the environment provided by beds, kitchens and homes in general, where the sun's rays do not reach them. Mites remain in mattresses, carpets, furniture and bedding, since they can climb lower down through the fabric to avoid sun, vacuum cleaners, and other hazards, and climb higher up to the surface if necessary to get another skin cell to feed on, when humidity is high.

A problem associated with prior art textiles such as carpets, is how to reduce allergic reactions, i.e. how to prevent or treat allergic reactions, from which users, and especially humans, may suffer, when coming into contact or in the vicinity of such textiles. Allergic reactions are for instance asthma, itchy watery eyes, allergic rhinitis (hay fever), persistent stuffy nose or ears, repeated sneezing upon awakening, atopic dermatitis (eczema), improvement of symptoms when outside the house, sneezing and a runny nose.

One may eliminate dust mites, dust mite allergens and other germs from carpets (herein further also shortly indicated as "allergens"). Herein, a solution is proposed to irradiate the carpet from the bottom side with UV light. In this way, the UV light reaches the target location first, after which is it substantially absorbed before leaving the carpet. Such solution is more convenient and may be much more effective than methods known in the art, such as described in for instance DE4220613.

DE4220613 document describes that UV light from the externally located light battery is led to the light conducting part and the light application part at the carpet. Elements are transparent and light conducting and esp. are made of glass and/or synthetic fibres. The system is provided with cleaning and/or other disinfecting units. It is arranged with motor driven fan and a switch and coupled or combined esp. to accept dust, e.g. in vacuum cleaner mode. The suction air for the cooling is filtered.

Hence, it is an aspect of the invention to provide an alternative carpet, which preferably further at least partially obviates one or more of above-described drawbacks, and which preferably may be used as "medical carpet" or "anti-allergen carpet" or "anti-allergy carpet", etc. in that it may be used in the prevention or treatment of allergy of a user vulnerable, especially humans, for dust mite allergy.

The invention provides in an embodiment a light source carpet construction (herein also indicated as "carpet construction") comprising (a) a light source and (b) a tufted carpet comprising a primary backing layer having a primary backing layer top face and a primary backing bottom face, the primary backing layer further comprising yarns integrated in the primary backing layer with tufts protruding from the primary backing layer at the primary backing layer top face, the tufts thereby forming a carpet top face, wherein the light source is arranged to illuminate the primary backing layer, wherein the intensity of the light at the carpet top face is smaller than the intensity of the light at the primary backing layer top face, and wherein the light source is arranged to generate light having a wavelength selected from the range of about 200-400 nm (herein also indicated as UV light).

Advantageously, the UV light is substantially or entirely confined to the carpet, and may substantially not escape from the carpet to the exterior, i.e., substantially no UV light may be received by animals, especially no light may be received by human beings, which may be in the vicinity of the carpet (walking on the carpet, sitting on a chair on the carpet, etc.).

An advantage of this approach may be that the UV radiation is now able to reach the dust mites, allergens and other germs, while at the same time the UV light may be substantially be blocked by the carpet fabric (i.e. especially the tufts and the primary backing layer), thereby protecting users against the (harmful) UV radiation. Another advantage may be that the UV doses may be higher and/or irradiation may be longer than in conventional methods such as described in DE4220613.

Therefore, the invention advantageously provides a light source carpet construction for use in the prevention or treatment of allergy of a user vulnerable for dust mite allergy. Applications of this type of carpet construction are for instance within hospitality, automotive, homes, hospitals, etc.

The term "light source carpet construction", or shortly "carpet construction" indicates a combination of at least a light source and a carpet, which may be integrated, but which may also be separate items that are arranged in specific configuration such as to allow illumination of the primary backing layer, especially in such a way, that the intensity of the light at the carpet top face is smaller than the intensity of the light at the primary backing layer top face.

In a number of general embodiments, the primary backing layer is illuminated by the light source from "below", i.e. the light source is arranged to illuminate the primary backing bottom face. In this way, light may at least partially penetrate the primary backing layer and the intensity of the light reduces with distance from the light source. This intensity is preferably substantially equal to zero at the carpet top face, but may still have a non-zero value at or (just) above the primary backing layer top face (but below the carpet top face).

The phrase "wherein the intensity of the light at the carpet top face is smaller than the intensity of the light at the primary backing layer top face", does not exclude embodiments wherein already at or close to the primary backing layer top face the intensity is close to zero or even zero. It however preferably indicates that when the light intensity at the primary backing layer top face is substantially zero, than at the carpet top face, the light intensity is at least also substantially zero, but when the light intensity at the primary backing layer top face is larger than zero, the light intensity at the carpet top face is at least smaller than at the primary backing layer top face. This will "automatically" be obtained in embodiments wherein the light source is arranged "below" the primary backing layer.

Terms like "below" and "above" relate to positions or arrangements of items which would be obtained when the carpet or carpet construction are arranged substantially flat on a substantially horizontal surface with the carpet bottom face of the carpet on such surface or on a surface substantially parallel to the substantially horizontal surface. However, this does not exclude the use of the carpet or carpet construction in other arrangements, such as on a roll, or against a wall, or in other (vertical) arrangements, such as for instance as goblin.

The term "carpet" herein especially refers to tufted carpets, but in an embodiment also to tufted rugs and in another embodiment also to tufted goblins. In yet another embodiment, the term carpet refers to tufted car mats. Examples are also tufted carpets that are used as wall or roof covering, or tufted bath mats. Herein, the "tufted carpet" is as indicated as "carpet".

Light Source

In a specific embodiment, the light source and the tufted carpet are arranged as laminate, wherein the light source is arranged to illuminate the primary backing bottom face. Such light source may for instance be a (flat) light panel, on which the carpet is arranged or to which the carpet is attached. Such light source may have light emitting surface, which may be in physical contact of the carpet bottom layer.

In a specific embodiment, the invention also relates to the use of a (conventional) tufted carpet and a flat light panel, arranged to generate UV light, wherein the (conventional) tufted carpet and the flat light panel are arranged as stack, for instance on a floor, wherein the light source is arranged to illuminate the primary backing layer of the carpet (see also below), optionally through a secondary backing layer (see also below).

In another embodiment, the light source is at least partially integrated in the primary backing layer. The term "at least partially integrated" may indicate that the light source is completely integrated in the layer, or part of it may protrude from the layer. In an embodiment, light source may be arranged in a recess in the layer. This may especially apply for LEDs.

In an embodiment, the light source may especially comprise an UV LED.

In an embodiment, the term "the light source" may also comprise a plurality of light sources. Therefore, the term "light source" may refer to a plurality of light sources, such as a plurality of UV LEDs. The plurality of LEDs may generate light with substantially similar spectra, but may also generate light with substantially different spectra. Hence, the plurality of LEDs may generate substantially the same color of light or may generate a plurality of colors. The term "plurality of LEDs" refers to 2 or more LEDs, especially 2-100,000 LEDs. In general, the carpet may comprise 2-10.000 LEDs/$m^2$ carpet, especially 25-2,500, LEDs/$m^2$ carpet.

Herein, the invention is especially described with reference to LEDs. Therefore, where applicable, the term LED may in embodiments also be interpreted broader as "light source". In general however, the term LED will especially refer to LEDs and not to light sources in general. The term LED herein further especially relates to solid state lighting. In an embodiment, it may also refer to an OLED (organic LED).

Especially, the LEDs may be arranged in recesses. The primary backing layer top face and/or the primary backing layer bottom face may comprise recesses to host the LEDs. When a secondary backing layer (also see below) is present, alternatively or in addition, the secondary backing layer top face and/or the secondary backing layer bottom face may comprises recesses to host the LEDs. When further the adhesive layer (also see below) is present, the alternatively or in addition, the adhesive layer top face and/or the adhesive layer bottom face may comprises recesses to host the LEDs.

As mentioned above, preferably one or more light source(s) may be arranged in a layer recess of a layer selected from the group consisting of the primary backing layer, the optional secondary backing layer, and the optional adhesive layer as described above. Hence, the recess may be arranged in the primary backing layer, in the optional secondary backing layer, and when the optional secondary backing layer is present, also in the optional adhesive layer. In general, the light source(s), especially the LED(s), will be attached to one of these layers. The light source(s) may thus be arranged in recesses in the layer to which the light source(s) are attached, but the recesses may also be arranged in a layer adjacent from the layer to which the light source(s) are attached. The phrase "one or more light source(s) may be arranged in a layer recess of a layer selected from the group consisting of the primary backing layer, the optional secondary backing layer, and the optional adhesive layer" indicates that at least part of the total number of the plurality of light source(s) is arranged in the indicated layer(s). In/on other layers, optionally also light source(s) may be arranged in recesses in the layers, and/or elsewhere on the layers.

According to an embodiment of the invention, the LEDs are integrated in the secondary backing layer, wherein the secondary backing layer is permeable to light for allowing transmission of the light from the light source to the adhesive layer, or the LEDs are provided on the secondary backing layer top face. These two arrangements of the LEDs and the secondary backing layer may ensure that the light from the light source reaches the adhesive layer (if present), to be further transmitted to the primary backing layer top face. The advantage of this approach is that the light source(s) is (are) protected within the carpet. The light source(s) may be protected against e.g. abrasion or impact, which could damage e.g. the electronics or damage a water-tight seal around the electronics. On the pile surface side, the light source(s) are protected by the primary backing with tufts, and on the opposite side the light source(s) are protected by the secondary backing. Protection of the backside is especially important during installation of the carpet. Hence, it is thus also advantageous to use the current invention in a light permeable secondary backing of carpet. The reason for this is that for high quality carpet a certain air permeability of the secondary backing is required to achieve high delamination strength. Especially an air permeability of the secondary backing, determined according to ASTM standard D-737, with a pressure differential equal to 0.5 inch water of at least about 250 $ft^3/min/ft^2$ is preferred.

The light source is arranged to generate light having a wavelength selected from the range of about 200-400 nm (herein also indicated as UV light); the light source is especially arranged to generate light having a wavelength selected from the range of about 300-400 nm, more preferably 310-350 nm. It appears that especially at these wavelength ranges, the allergens may be treated well and allergic reactions by people vulnerable to allergic reactions to dust mite may be diminished or substantially prevented.

Preferably, the light source is arranged to illuminate the primary backing layer with an irradiance selected from the range of about 50-10,000 $mW/m^2$. It appears that especially with this irradiance the allergens may be treated well, while on the other hand escape of light to the exterior (through part of the primary backing layer and the tufts) may be low or substantially zero.

In a specific embodiment, the light source carpet construction further comprises a waveguide, wherein the light source is arranged to couple at least part of the light into the waveguide, and wherein the waveguide is arranged to illuminate the primary backing layer. In an embodiment, the waveguide comprises a plurality of fibres.

Such waveguide may in an embodiment be arranged upstream of the primary backing layer, for instance attached to the primary backing bottom layer, but may in an embodiment also be integrated in an adhesive layer (see also below). The terms "upstream" and "downstream" relate to arrangement of items relative to the propagation of the light from the light source, wherein relative to a first position within a beam of light from the light source, a second position in the beam of light closer to the light source is "upstream", and a third position within the beam of light further away from the light source is "downstream".

Further, the carpet construction may comprise a power source. The power source may be arranged external from the carpet. However, the power source may also be implemented in the carpet. Each light source may possess its (implemented) own power source, but one or more power sources may also be arranged to provide power to one or light source (subsets of light sources, such as LEDs). The term "power source" may thus also relate to a plurality of power sources. The term "implemented" herein may indicate that the power source is integrated in the carpet, such as in the secondary backing layer. However, the term "implemented" herein may also indicate that the power source is attached to the carpet, such as laminated to the bottom layer of the carpet.

The invention is related to carpets with the power source implemented, as well to combinations of carpets with the power source, wherein the power source is external from the carpets, as well to carpets without power sources, but which are arranged to be electrical connectable to an external power source to receive electric power from the external power source when connected and to provide UV light when switched on.

Primary and Secondary Backing Layer

For dimensional strength reasons, in general the carpet of the invention will comprise a secondary backing layer. Hence, in a specific embodiment, the light source carpet construction further comprises a secondary backing layer having a secondary backing layer top face and a secondary backing bottom face, wherein the primary backing layer and the secondary backing layer are arranged as laminate, wherein the secondary backing layer top face is directed to the primary backing bottom face. The light source may at least partially be integrated in the secondary backing layer. Again, the term "at least partially integrated" may indicate that the light source is completely integrated in the layer, or part of it may protrude from the layer. In an embodiment, light source may be arranged in a recess in the layer. As will be clear to the person skilled in the art, combinations of embodiments may be possible, and the carpet construction may for instance comprise a plurality of light sources, with a number (≥1) of light sources at least partly arranged in the primary backing layer and a number (≥1) of light sources at least partly arranged in the secondary backing layer.

The primary backing layer has a primary backing layer top face and a primary backing bottom face. The secondary backing layer has a secondary backing layer top face and a secondary backing bottom face. The carpet has a carpet top face and a carpet bottom face. The primary backing layer and the optional secondary backing layer and the optional adhesive layer form a stack or laminate of one or more layer, more precisely, form the carpet, having the carpet top face and a carpet bottom face as "boundaries".

Note that the terms "bottom" and "top" are only used to elucidate in a clear way the different faces of objects such as of the primary backing layer, the adhesive layer (see below), the secondary backing layer and the laminate. The use of the terms "bottom" and "top" does not limit the carpet of the invention as claimed, neither its use, to the configurations schematically depicted in the accompanying drawings. Also carpets on a roll are claimed herein.

The term "primary backing layer" may include a primary backing layer comprising a plurality of layers. Likewise, the term "secondary backing layer" may include a secondary backing layer comprising a plurality of layers.

According to a further embodiment of the invention, the primary backing layer is permeable to UV light.

As used in this description, the terms 'permeable to light' or 'light permeable' or "transmissive for the light" mean that all or part of the UV light is permitted to pass through the material, with or without being diffused.

Such light permeable or transmissive primary backing layer, or adhesive layer or secondary backing layer, are especially relevant when the light source(s) are arranged between the primary backing layer top face and the carpet bottom face, and especially when the light sources are arranged between the primary backing layer bottom face and the carpet bottom face, such as in at least one of the optional adhesive layer and/or the optional secondary backing layer.

Note, as mentioned above, in an embodiment a (conventional) tufted carpet and the flat light panel may be arranged as stack, for instance on a floor, wherein the light source is arranged to illuminate the primary backing layer of the carpet (see also below), optionally through a secondary backing layer (see also below). Thus, the light source may in an embodiment also be located separately below the secondary backing (upstream from the secondary backing).

The term "transmissive" may indicate that all light is at least partly transmitted but may alternatively or additionally also indicate that some parts of the light spectrum is (at least partly) transmitted and other parts are substantially not transmitted. Layers, especially the adhesive layer (if permeable to light) may be more permeable to some parts of the UV spectrum than to other parts of the UV spectrum.

The terms "permeable for light", "permeable to light" or "light permeable" or "transmissive" relate to the light transmitted by a material, such as a layer. Herein, the term "transmitted" or "transmission" relate to undisturbed transmission (substantially no scattering in the material) and/or disturbed transmission (after scattering, like in translucent materials). Hence, the terms "permeable for light" or "light permeable" may also herein be indicated as "transmission".

The transmission or permeability can be determined by providing light at a specific wavelength with a first intensity to the material and relating the intensity of the integrated light at that wavelength measured after transmission through the material, to the first intensity of the light provided at that specific wavelength to the material (see also E-208 and E-406 of the CRC Handbook of Chemistry and Physics, 69$^{th}$ edition, 1088-1989). The terms "permeable for light" or "light permeable" may indicate that at least 1% of the light is transmitted, more preferably at least 10% of the light, even more preferably at least 30% of the light, by the material or layer. Note that even a low transmission may for this application be allowable, especially when using high-power LEDs. In general, the permeability for light, such as of the primary backing layer, of the secondary backing layer and of the adhesive layer, is especially determined in relation to UV light travelling in the direction to the carpet top layer.

The primary backing layer, especially in embodiments wherein the light source(s) are arranged between the primary backing layer and the carpet bottom face, preferably has a light permeability for UV light of at least about 1%, even more preferably at least about 10%, yet even more preferably at least about 30%, or even more preferably at least about 50%. Any other downstream material or layer, arranged downstream of the light source(s) (i.e. arranged between the light source(s) and the primary backing layer top face) has preferably a light permeability of at least about 1%, even more preferably at least about 10%, yet even more preferably at least about 30%, or even more preferably at least about 50%. These values especially apply in transversal direction, i.e. the transmission of at least about 30%, is a transmission of at least about 30% through the respective layer (here the primary backing layer). The term "transversal direction" indicates a direction substantially perpendicular to the respective layer(s).

The transmissiveness of the tufts, especially the parts of the tufts protruding from the primary backing top layer, is preferably very small, thereby preferably reducing to a high extent possible escape from UV light to the exterior over the carpet top layer. Note that the transmissiveness of the tufts, as will be clear to the person skilled in the art, may be dependent upon the color or the tufts, the length of the tufts and the packing density of the tufts.

As used in this description, the term 'secondary backing layer' includes in general the backing layer which forms the surface of the carpet opposite from the pile surface. Such a layer is usually referred as a 'secondary backing layer' and is commercially available.

These 'secondary backing layers' have an advantage in that they are well-suited for carpet backing and fit in well with the carpet manufacturing method used in carpet factories. Advantages of using the secondary backing layer may be protection of the light sources, such as LEDs, optional power sources as well as providing strength to the carpet. Hence, preferably the tufted carpet according to the invention comprises the secondary backing layer. The invention is however not restricted to the presence of the secondary backing layer, but further and/or other layers may be present, such as on the side of the secondary backing layer facing away from the adhesive layer (i.e. between the secondary backing layer bottom face and the carpet bottom face), but also elsewhere (see also above).

According to a further embodiment of the invention the secondary backing layer has an air permeability of at least about 70 $m^3/min/m^2$. Air permeability of the secondary backing layer can be determined according to ASTM D-737, with a pressure differential equal to 0.5 inch (1.27 cm) water. An acceptable value is 250 $ft^3/min/ft^2$ (76.2 $m^3/min/m^2$), but more preferred values are in the range of 350-800 $ft^3/min/ft^2$ (106.7-243.8 $m^3/min/m^2$). Secondary backing layers with an air permeability of below about 70 $ft^3/min/ft^2$ (24.4 $m^3/min/m^2$) are considered to be inadequate for high binder cure rates.

Further, with respect to the secondary backing layer, in an embodiment this secondary backing layer may be based upon an existing product for the secondary backing layer, such as the one known under the name ActionBac®. This is a backing made of a leno weave of slit film and spun olefin yarns. It has a 2.1 ounce per square yard (0.71 gram per square meter) fabric with polypropylene warp tapes and polypropylene multifilament picks in a leno wave with averages of 16 warps per inch (per 2.54 cm) and 5 picks per inch (per 2.54 cm). Such a backing layer imparts dimensional stability with good delamination strength in carpets. This backing layer also has openness well suited for robust curing rates during manufacture. The air permeability of this backing, determined according to ASTM D-737 with a pressure differential equal to 0.5 inch water, exceeds about 750 $ft^3/min/ft^2$ (229 $m^3/min/m^2$), which is ample for robust binder cure rates. Another such product with a higher count, 18×13, leno wave construction, has average air permeability above about 720 $ft^3/min/ft^2$(219 $m^3/min/m^2$). This is also well suited for efficient cure rates. Preferably, the secondary backing layer has a high adhesive compatibility with the material used for the adhesive layer, so that the carpet will pass delamination test such as the test described in ASTM D-3936. The delamination resistance-imparting properties should preferably be such that the backing when laminated in the reference carpets described has a delamination strength of at least 2.5 pounds/in (44.6 kg/m). However, preferred values are greater than 3-4 pounds/in (53.6-71.4 kg/m), more preferably at least 5.5 pounds/in (98.2 kg/m) and even more preferably at least 6 pounds/in (107.1 kg/m).

To prevent delamination good bonding is required. Bonding may be improved by having sufficient openness not to impede passage of vaporized binders liquids from the carpet during curing.

It should be noted that any other existing secondary backing material may be used as basis for the secondary backing layer used in this invention. Other examples are needlefelt backings, rubber backings, PVC backings, polyurethane backings, vinyl backings, cushion backings, nylon backings. The fibres in the needlefelt backings are needled for bonding. It is also noted that a cushion or padding may be integrated in the secondary backing. Another example of a secondary backing material is bitumen. This material is used when extra sturdy carpet is required, such as for example in carpet tiles, or in car mats. In some embodiments bitumen may also be used as adhesive. As mentioned above, preferably such secondary backing layer is comprised in the tufted carpet according to the invention. According to a further embodiment of the invention, the secondary backing layer has apertures for air passage. Vaporized binders used for the adhesive layer can pass through the apertures during curing of the carpet. With this embodiment, it may be ensured that the air permeability of the secondary backing layer is sufficiently high.

According to a further embodiment of the invention, the carpet has a delamination strength of at least 44.6 kg/m between the primary backing layer and the secondary backing layer. This requirement is sometimes also indicated as "peel strength" and is normally tested according to ASTM D-3936.

The carpet may further optionally comprise more layers than the primary backing layer, the optional adhesive layer, and the optional secondary backing layer. Such optional layer(s) may be arranged between the primary backing layer and the adhesive layer, between the primary backing layer and the secondary backing layer (in embodiments wherein the adhesive layer is not present), between the adhesive layer and the secondary backing layer and between the secondary backing layer and the carpet bottom face, etc. Examples of such additional optional layer may be scattering layers and reflective layers. More than one optional further layer may be present in the carpet laminate. In general, when the carpet comprises the secondary backing layer, the secondary backing bottom face is the carpet bottom face.

In one embodiment, the carpet does not comprise a secondary backing at all, but only a primary backing layer is provided.

Adhesive Layer

The primary backing layer and secondary backing layer may in an embodiment be laminated to each other by means known in the art. Therefore, the carpet may be a laminate, herein also indicated as "carpet laminate" or simply "laminate". Note that the light source carpet construction may also be a laminate of the carpet (laminate) and the light source. In a further embodiment, the carpet further comprises an adhesive layer arranged between at least part of the primary backing layer and the secondary backing layer. Such layer may be used to adhere the primary backing layer to the secondary backing layer (see also below).

The optional adhesive layer may be an integral layer, substantially having the same length and width dimensions as the primary backing layer, but may also consist of parts. For instance, good adhesion between the primary and secondary backing layer may also be achieved wherein there are "layer domains" i.e. parts of the primary and secondary backing layers are adhered to each other by the adhesive layer, and parts are laminated to each other without the adhesive layer in between. The person skilled in the art may optimize the dimensions of the optional adhesive layer in order to obtain the desired results.

Preferably, an adhesive layer is applied to attach the primary layer and secondary layer to each other. Hence, in an embodiment, the tufted carpet further comprises an adhesive layer having an adhesive layer top face and an adhesive layer bottom face, arranged between the primary backing layer and the secondary backing layer, wherein the adhesive layer is preferably at least partially permeable for the UV light. Therefore, the invention provides an embodiment of the tufted carpet comprising the primary backing layer, the adhesive layer, and the secondary backing layer.

Hence, in this embodiment, at least part of the primary backing layer bottom face of the primary backing layer is in contact with at least part of the adhesive layer top face of the adhesive layer, and at least part of the adhesive layer bottom face (opposite of the adhesive layer top face) of the adhesive layer is in contact with at least part of the secondary backing layer top face. In this way, the laminate is provided, here being a "stack" of the primary backing layer, the adhesive layer and the secondary backing layer.

In a preferred embodiment, the adhesive layer is permeable to UV light, and preferably the light sources, such as LEDs, are arranged in one or more of the adhesive layer and the secondary backing layer (especially in recesses in one or more of these layers). When the adhesive layer is permeable to the UV light, the light of the LEDs may more easily travel to the carpet top face or carpet surface.

The adhesive layer comprises an adhesive layer top face, directed to the primary backing layer and an adhesive layer bottom face directed to the secondary backing layer.

In general, when using a secondary backing layer, an adhesive layer is arranged between the primary and secondary backing layers. Hence, in an embodiment, the light source carpet construction further comprises an adhesive layer, wherein the primary backing layer, the adhesive layer, and the secondary backing layer are arranged as laminate, and wherein adhesive layer is arranged between the primary backing layer and the secondary backing layer. The light source may at least partially be integrated in the adhesive layer. Again, the term "at least partially integrated" may indicate that the light source is completely integrated in the layer, or part of it may protrude from the layer. In an embodiment, light source may be arranged in a recess in the layer.

As will be clear to the person skilled in the art, combinations of embodiments may be possible, and the carpet construction may for instance comprise a plurality of light sources, with a number (≥1) of light sources at least partly arranged in the primary backing layer and/or a number (≥1) of light sources at least partly arranged in the secondary backing layer or/and a number (≥1) of light sources at least partly arranged the adhesive layer.

When arranging the light source(s) in the adhesive layer or below the adhesive layer, or when arranging the light source(s) in the secondary backing layer or below the secondary backing layer, preferably, the adhesive layer is at least partially transmissive for the light of the light source. The term "at least partially transmissive" may indicate that part of the adhesive layer may be transmissive, and another part of the adhesive layer, especially a part laterally arranged, may not be transmissive for the light.

The term "adhesive layer" may in an embodiment include an adhesive layer comprising a plurality of adhesive layers (such as a pre-coat layer and adhesive layer) and may in another embodiment include an adhesive layer comprising a plurality (such as a mixture) of adhesives. For instance, the adhesive layer may be present on the backside of the primary backing and adhering the tufts to the primary backing layer and holding the tufts in place as well as adhering the primary backing layer and the secondary backing layer to each other (with for instance the light source(s) within the adhesive layer). Or a first adhesive layer may be present on the backside of the primary backing and adheres the tufts to the primary backing layer and holds the tufts in place, and a second adhesive layer, on top of the first adhesive layer, for adhering the primary backing layer and the secondary backing layer (with for instance the light source(s) within the second adhesive layer). Such adhesive layers, though optionally also being based on different adhesives, are herein indicated as adhesive layer.

Especially in those embodiments wherein the light source(s) are at least partially arranged in the adhesive layer or in embodiments wherein light source(s) are arranged in the secondary backing layer, it is preferred that the adhesive layer is permeable for UV light. Hence, in an embodiment, the adhesive layer is permeable for UV light.

Therefore, the adhesive layer holding the tufts in place may in an embodiment be used to hold the light source(s), such as LED(s), in place under the primary backing layer. The LEDs may be positioned between the primary backing layer bottom face of the primary backing layer and the adhesive layer top face of the adhesive layer. Opening(s) (recesses) may be provided in the surface of the adhesive layer top face directed to the primary backing layer, in which the light source can be placed.

According to a preferred embodiment of the invention, the adhesive layer is at least partially permeable to light for allowing transmission of the light from the light source(s) to the primary backing layer. This allows that the light source(s) may be arranged on the adhesive layer bottom face. In this case, the light source(s) may optionally be fixed in place with an additional adhesive means. The light source(s) may also be fully encapsulated in the adhesive layer. Alternatively, the light source(s) may be positioned under the adhesive layer within a space between the carpet bottom face and the adhesive layer.

In a further embodiment, the adhesive layer further comprises scattering particles, such as $TiO_2$ or calcium carbonate particles. Such particles may improve light outcoupling and/or a homogeneous light distribution/outcoupling over the carpet. Hence, such particles are arranged to scatter part of the UV light in the adhesive layer.

According to a further embodiment of the invention, the adhesive layer comprises light scattering particles, which are also referred as fillers. Fillers have the advantage of reducing the cost of the carpet, while bulking up the adhesive at the same time. Because the fillers scatter light, this results in that the light from the carpet appears to originate from an area larger than the original emission spot. It is advantageous when a homogeneous light emission is desired. The light scattering particles may be calcium carbonate. The advantage of calcium carbonate is that it is of relatively low cost. Calcium carbonate may be in the form of calcite or chalk. The light scattering particles may also be kaolinite such as china clay fillers. Typically the fillers are used in quantities such as for example 600 g/l (relative to the adhesive+filler+ optional additives in the liquid state to be applied as adhesive to form an adhesive layer), but for many embodiments of the current invention it is preferred that much lower amounts are used in order to increase the light transmittance for example, lower than 60 g/l or even lower than 6 g/l. In the latter case, the fillers function as light diffuser without substantially hindering the optical translucence. When reducing the amount of filler, the total amount of adhesive may also be reduced, for example to 400 g/m$^2$ (instead of typically 700 g/m$^2$) for the pre-coat layer and 400 g/m$^2$ (instead of typically 600 g/m$^2$) for the adhesive layer (dry weight).

According to a further embodiment of the invention, the adhesive layer comprises electrically conductive particles. The electrically conductive particles may give the carpet anti-static properties. The electrically conductive particles may be e.g. carbon black, potassium formate (HCOOK), tin-oxide, indium-tin-oxide or silver.

According to a further embodiment of the invention, the adhesive layer comprises anti-oxidants. The anti-oxidants make the adhesive layer more resistant to heat. This is advantageous because LEDs can generate a substantial amount of heat. Also, latex without anti-oxidants may age faster and become yellow after some time, due to which it starts to absorb light, such as possibly the waveguide light.

The amount of anti-oxidants may be in the range of 1-3 parts per 100 parts adhesive layer, such as latex (per wet weight), but more preferably it is in the range 4-6 parts per 100 parts latex, or even 7-9 parts per 100 parts latex. The anti-oxidants may especially be important, because otherwise the UV light might reduce the lifetime of the adhesive and with it the lifetime of the carpet.

According to a further embodiment of the invention, the adhesive layer comprises latex. The latex may be light permeable latex. It is noted that the adhesive layer may substantially consist of latex. The latex may be based on terpolymers of styrene, butadiene and an acidic vinyl monomer. When the adhesive layer substantially consists of light permeable latex and comprise substantially no light scattering particles, the light from the light source(s) may efficiently travel through the adhesive layer. Thus, preferably no light scattering fillers are used in the adhesive and the adhesive layer is light permeable. Therefore, in an embodiment, the adhesive layer is free from light scattering particles. The phrase "is free from . . . " and similar phrase or terms especially indicate that something "is substantially free from . . . ".

According to a further embodiment of the invention, the adhesive layer comprises acrylics. The acrylics may be light permeable acrylics. It is noted that the adhesive layer may substantially consist of acrylics. An example of acrylics is polyacrylate ester. Advantages of acrylics are hardness, flexibility and resistance against UV. Acrylics are also highly resistant to heat, which makes it an especially suitable material for use in combination with LEDs, which generate a relatively large amount of heat. Latex and acrylics may also be used in combination.

In a preferred embodiment a polyolefin dispersion is used as pre-coat (on for instance the primary layer for subsequent providing the adhesive layer) and/or the adhesive layer itself. A suitable polyolefin dispersion may for instance be HYPOD™ of Dow Chemical. These are propylene- and ethylene-based dispersions that combine the performance of high-molecular-weight thermoplastics and elastomers with the application advantages of a high-solids waterborne dispersion. Polyolefin dispersions can provide benefits to carpet manufacturers by allowing them to apply a thermoplastic backing using conventional coating equipment. For example, using a carpet backing of PVB (poly vinyl butyral), or polypropylene, the problem of UV sensitivity may be solved, while at the same time increasing the UV-light permeability. Hence, another suitable polyolefin dispersion may be a pvb-based dispersion. However, other thermoplastics might have an even higher UV-light permeability.

Therefore, in an embodiment, the adhesive layer preferably comprises one or more of an acrylic adhesive and a polyolefin dispersion adhesive.

Controller & Sensor

The light source carpet construction may further comprise a controller, which may especially be arranged to control the irradiance of the primary backing layer by the light source.

In an embodiment, the light source carpet construction further comprises a sensor, arranged to sense one or more of the presence of a user in a space comprising the tufted carpet and the pressure of a user on the tufted carpet, and arranged to provide a corresponding sensor signal, wherein the controller is arranged to control the irradiance of the primary backing layer by the light source as function of the sensor signal by the sensor.

The controller may be integrated in the carpet, may be attached to the carpet, but may also be arranged (i.e. arrangeable) separate from the carpet.

The light source carpet construction may further comprise a user interface. The user interface may electrically be connected to the controller. The user interface or user input device ("local" or "remote") controls the lighting generated of the light source(s) of the light source carpet construction as selected by the user. The interface or input device may comprise control action buttons shown in an intuitive way, how the end user can navigate along the available settings. An intelligent microprocessor may allow a user to generate dynamic light effects via an algorithm. The user interface may comprise a remote control unit.

For instance, the user interface may be arranged to allow a user to choose to keep the carpet irradiated continuously, for instance at a relatively low UV irradiance, such as in the range of about 50-1,000 mW/m$^2$, or to irradiate the carpet for a predefined time, for instance at a relatively high UV irradiance, such as in the range of about 1,000-10,000 mW/m$^2$, especially 2500-10,000 mW/m$^2$, and then turn if off thereafter (for instance another predefined time). For instance, the carpet may be irradiated at 7,500 mW/m$^2$ for a duration of 10 hours, after which the light is turned off (for example for a week). Preferably the user leaves the room during exposure, to avoid the risk of UV damage. In an embodiment, the controller may be arranged to control the irradiance of the primary backing layer by the light source as a function of time (for instance only irradiation during the night). Again, in an embodiment, the user interface may be arranged to allow a user to choose to control the irradiance of the primary backing layer by the light source as a function of time.

BRIEF DESCRIPTION OF THE DRAWINGS

Embodiments of the invention will now be described, by way of example only, with reference to the accompanying schematic drawings in which corresponding reference symbols indicate corresponding parts, and in which.

DESCRIPTION OF PREFERRED EMBODIMENTS

Figure 1A:
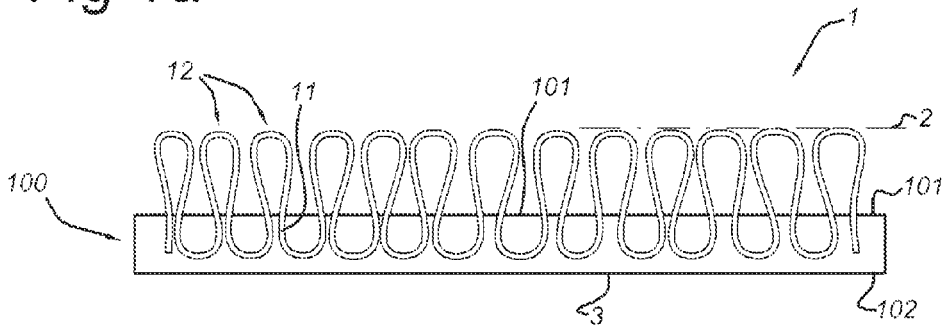
FIGS. 1*a*-1*c* schematically depict embodiments of the carpets comprising a primary backing layer (1*a*), a primary and a secondary backing layer (1*b*), and a primary backing layer, and adhesive layer and a secondary backing layer (1*c*), respectively.
Figure 1B:
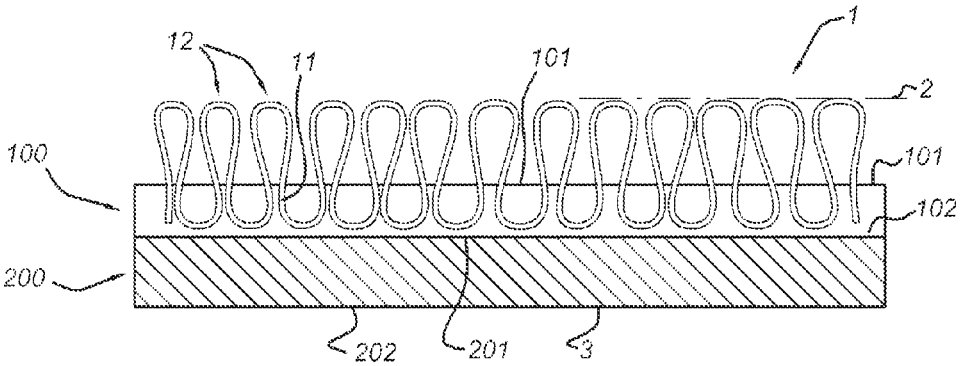
Figure 1C:
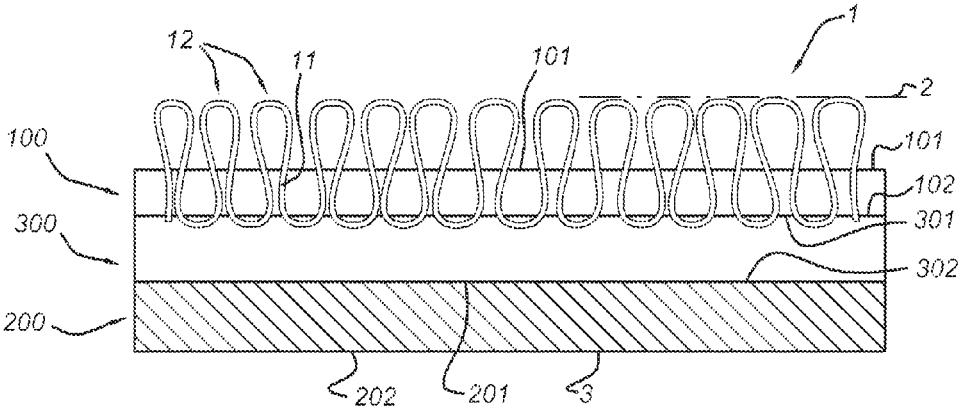

FIGS. 1*a*-1*c* schematically depict embodiments of a carpet 1 comprising a primary backing layer 100 (FIG. 1*a*), a primary backing layer 100 and a secondary backing layer 200 (FIG. 1*b*), and a primary backing layer 100, an adhesive layer 300 and a secondary backing layer 200, respectively, wherein in the latter the adhesive layer 300 is arranged between the primary backing layer 100 and the secondary backing layer 200. The adhesive layer 300 may also comprise domains (not depicted); i.e. the adhesive layer 300 may be arranged between part(s) of the primary backing layer 100 and the secondary backing layer 200. These drawings are discussed first, to more easy understand the light source carpet construction (see FIGS. 2*a*-2*g* and 3 and as discussed below), including embodiments of such carpets 1 as schematically depicted in FIGS. 1*a*-1*c*.

The primary backing layer 100 has a primary backing layer top face 101 and a primary backing bottom face 102. The secondary backing layer 200 has a secondary backing layer top face 201 and a secondary backing bottom face 202. The adhesive layer 300 has an adhesive layer top face 301 and an adhesive layer bottom face 302. The carpet has a carpet top face 2, i.e. the carpet surface intended to walk, rest, sit, arrange objects, etc., on, and a carpet bottom face 3. The primary backing layer 100 and the optional secondary backing layer 200 and the optional adhesive layer 300 may form a stack or laminate of one or more layers, more precisely, form the carpet 1, having the carpet top face 2 and a carpet bottom face 3 as "boundaries".

In FIG. 1*a*, the carpet bottom face 3 substantially coincides with the primary backing layer bottom face 102. In FIG. 1*b*, the primary backing layer bottom face 102 is adjacent to the secondary backing layer top face 201, and the carpet bottom face 3 substantially coincides with the secondary backing layer bottom face 202. In FIG. 1*c*, the primary backing layer bottom face 102 is adjacent to the adhesive top face 301, the adhesive bottom face 302 is adjacent to the secondary backing layer top face 201, and the carpet bottom face 3 substantially coincides with the secondary backing layer bottom face 202. Note that the terms "bottom" and "top" are only used to elucidate in a clear way the different faces of objects such as of the primary backing layer, the adhesive layer (see below), the secondary backing layer and the laminate. The use of the terms "bottom" and "top" does not limit the carpet of the invention as claimed, neither its use, to the configurations schematically depicted in the accompanying drawings.

The primary backing layer 100 is provided with yarns 11 forming tufts 12, here closed loop tufts, at the primary backing top face 101.

The carpet top face 2 is herein also indicated as "carpet side", or "side facing the user during its use as carpet".

FIGS. 2*a*-2*g* schematically depict arrangements of LEDs in embodiments of a light source carpet construction 1000 of the invention. Some of the schematic drawings are substantially the same as those of FIGS. 1*a*-1*c*, with the exception that light source(s) 40 are indicated by way of example.

The drawings are not intended to schematically depict all possible embodiments exhaustively.

Figure 2A:
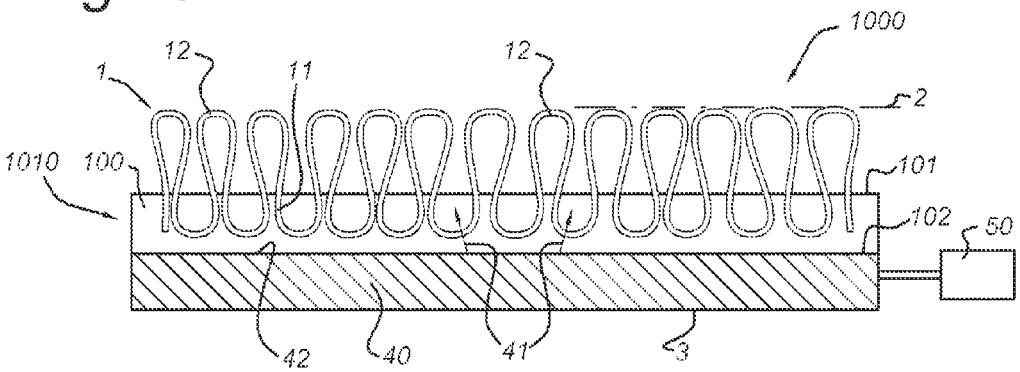
FIGS. 2*a*-2*g* schematically depict light source carpet construction embodiments of the invention.

FIG. 2*a* schematically depicts an embodiment of the light source carpet construction 1000 wherein the light source 40 and the tufted carpet 1 are arranged as a laminate (stack) 1010. The light source 40 is arranged to illuminate the primary backing bottom face 102.

The light source 40 can in this embodiment be a display type of device, on which the carpet 1 is arranged (in for instance a non-bound way). Such display may for instance comprise a plurality of UV lamps, like Hg or Xe discharge lamps.

However, the carpet 1 and light source 40 may in this embodiment also be attached (i.e. bound) to each other (via an adhesive or other means known in the art (not depicted)). By way of example, a power source 50 is depicted, electrically connected with the light source 40. Here, the light source 40 has a light emitting surface 42, arranged to emit light 41 of the light source in the direction of the primary backing layer 100, more precisely, the primary backing bottom face 102. In an embodiment, the light emitting surface 42 and the primary backing bottom face 102 are in contact which each other substantially over the whole surface of the light emitting surface 42.

Most of the light source(s) 40 in the schematic drawings 2*b*-2*g* are by way of example arranged in a recess 45. The examples especially refer to LEDs as light sources 40.

Figure 2B:
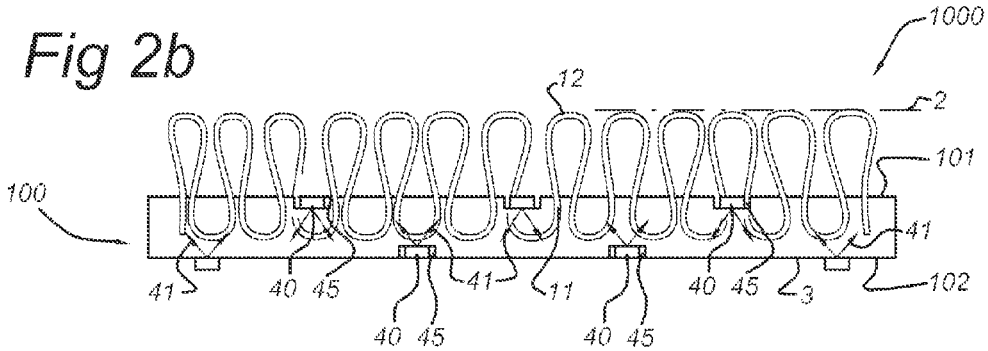
Figure 2C:
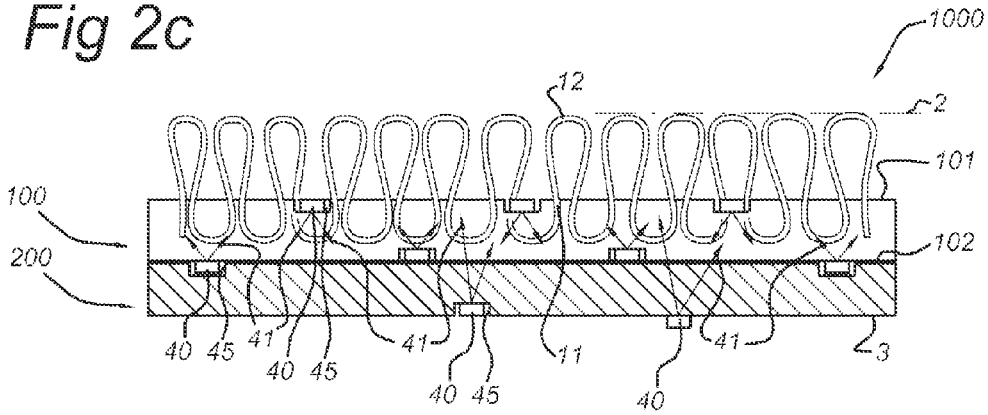
Figure 2D:
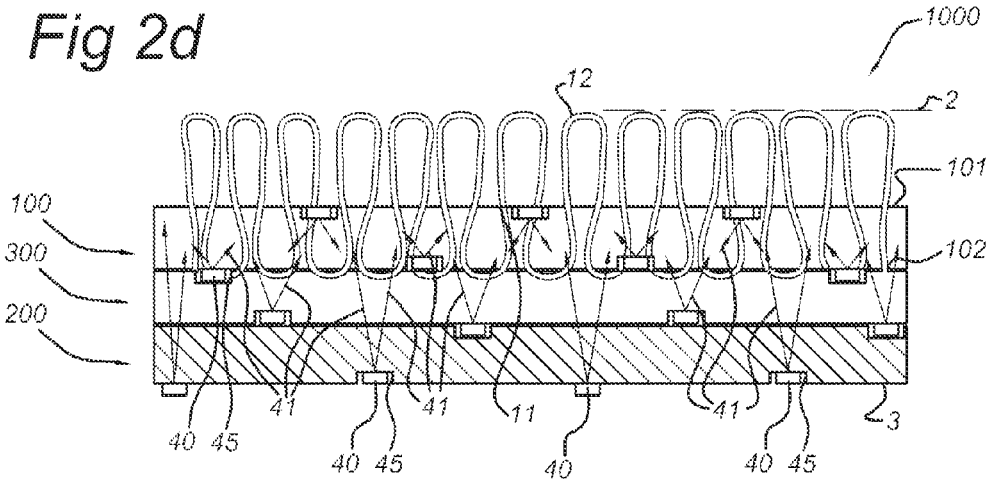

The use of a recess 45 has the advantage that the light source(s) are more protected from pressure by external sources. Light source(s) 40 may be arranged in recesses 45 in the primary backing layer top face 101, and/or in recesses 45 in the primary backing bottom face 102, and/or on the primary backing bottom face 102 (FIG. 2*b*). In addition or alternatively, light source(s) 40 may be arranged in recesses 45 in the secondary backing layer top face 201, and/or on the secondary backing layer top face 201, and/or in recesses 45 in the secondary backing bottom face 202 and/or, on the secondary backing bottom face 202 (FIG. 2*c*). Yet alternatively or in addition, light source(s) 40 may be arranged in recesses 45 in the adhesive layer top face 301, and/or on the adhesive layer top face 301, and/or in recesses 45 in the adhesive bottom face 302, and/or on the adhesive bottom face 302 (FIG. 2*d*). Note that dependent upon the arrangement of the light source(s) 40, it is preferred that the primary backing layer 100 and/or the adhesive layer 300 and/or the secondary backing layer 200 are permeable to UV light 41. For instance, light 41 of light source(s) arranged at the secondary backing bottom face 202 has to travel through at least part of the secondary backing layer 200, through the optional adhesive layer 300 and preferably also to a certain extent through the primary backing layer 100.

To illustrate the terms "upstream and "downstream": referring to FIG. 2*d*, assuming light source(s) 40 arranged in the secondary backing top face 201, such light source(s) 40 may also have light source(s) 40 arranged upstream (i.e. upstream of the light source(s) 40 arranged in the secondary backing top face 201), such as LEDs, arranged in the secondary backing bottom face 202 (here carpet bottom face 3), and/or may have light source(s) 40 arranged upstream (i.e. upstream of the light source(s) 40 arranged in the secondary backing top face 201), such as in the primary backing bottom face 102. Likewise, with light source(s) 40 arranged in the secondary backing layer 200, the optional adhesive layer 300 (see FIGS. 2*c* and 2*d*) is considered arranged downstream of the secondary backing layer 200, and the primary backing layer 100 is also considered arranged downstream of the secondary backing layer 200 (and also considered arranged downstream of the optional adhesive layer 300).

Summarizing, by way of example, in FIG. 2*b*, some of the light sources 40 are at least partially integrated in the primary backing layer 100; in FIG. 2*c*, some of the light sources 40 are at least partially integrated in the secondary backing layer 200 (and some are at least partially integrated in the primary backing layer 100); and, in FIG. 2*d*, some of the light sources 40 are at least partially integrated in the adhesive layer 300 (and some are at least partially integrated in the primary backing layer 100 or in the secondary backing layer 200).

Figure 2E:
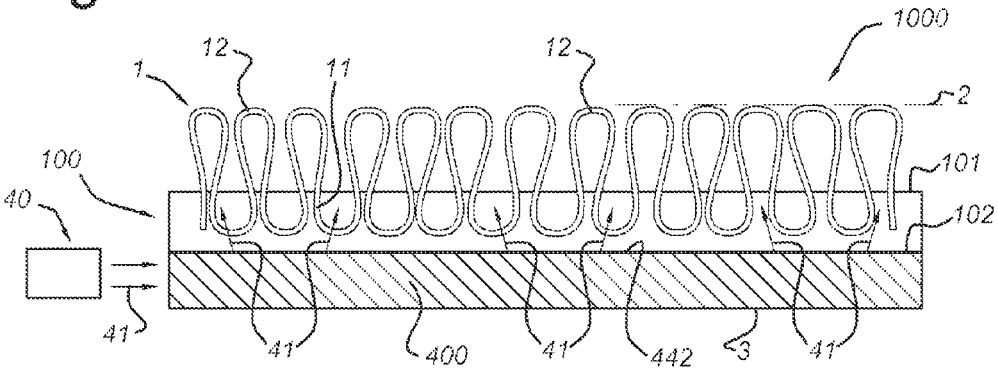

FIG. 2*e* schematically depicts an embodiment wherein the light source carpet construction 1000 further comprises a waveguide 400. The light source 40 is arranged to couple at least part of the light 41, especially UV light, into the waveguide 400. The waveguide 1000 is arranged to illuminate the primary backing layer 100. The waveguide 400 has a light emitting surface 442, arranged to illuminate the primary backing layer 100. Here, an embodiment is depicted wherein the light source 40 is arranged external from the carpet 1, but the light source 40 may also be at least partly integrated the carpet 1. For instance, the light source 40 may be integrated in the waveguide 400 or may be arranged "below" the waveguide 400.

In an example, the light source carpet construction 1000 comprises a plurality of LEDs as light sources 40, spaced at a distance of 4 cm, an each LED supplying a UV power of 125 μW at 254 nm wavelength. The total UV irradiance then becomes 75 $mW/m^2$. In order to distribute the UV radiation, each LED is equipped with an optical waveguide structure that distributes the light evenly over the area corresponding to the LED (for example a square area of 4×4 cm). The LEDs are arranged between the primary backing layer 100 and the secondary backing layer 200 or below the secondary backing layer 200.

Figure 2F:
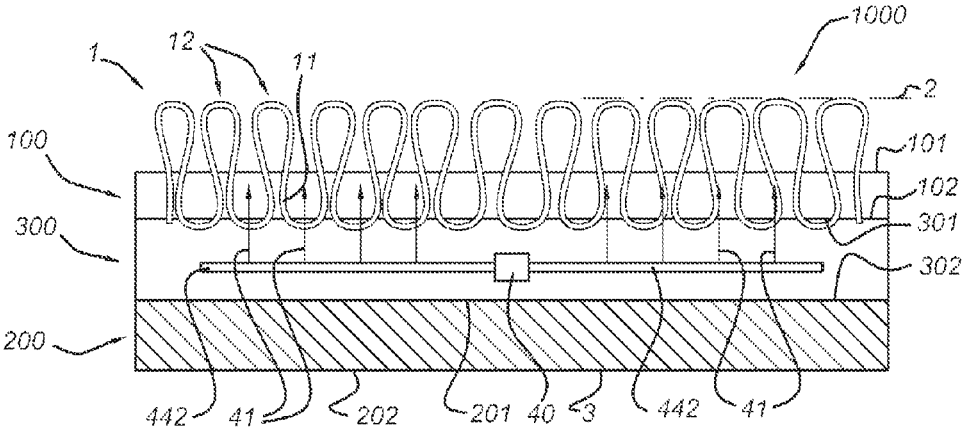

FIG. 2*f* schematically depicts an embodiment, wherein the carpet 1 comprises the primary backing layer 100, the adhesive 300 and the secondary backing layer 200. The carpet 1 further comprises a waveguide integrated in the adhesive layer 300, as well as the light source 40 integrated in the carpet 1 (here also in the adhesive). In this way, all optics are integrated in the carpet 1, thereby being protected from direct contact with a user.

Figure 2G:
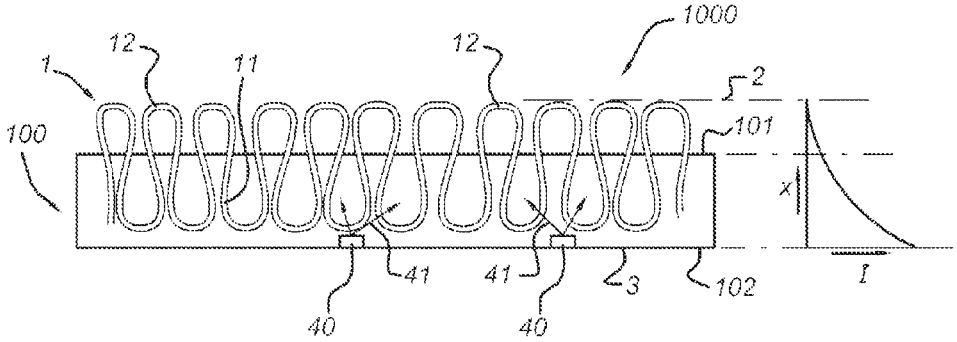

FIG. 2*g* is added to illustrate a possible distribution of the intensity of the light 41. As mentioned above, the light source 40 is arranged to illuminate the primary backing layer 100. This illumination or irradiation is performed in such a way that the intensity $I_2$ of the light 41 at the carpet top face 2 is smaller than the intensity $I_{101}$ of the light 41 at the primary backing layer top face 101. Configurations to obtain such intensity distribution may be for instance the arrangement of light sources in the adhesive layer 300 or the secondary backing layer 200, at least below the primary backing layer. FIG. 2*g* by way of example shows a configuration of light sources 40, such as LEDs, at the primary backing bottom face 102. Light 41 may penetrate through the primary backing layer 100 and may optionally also escape thereof. Preferably, the type of light source(s) 40, the arrangement of the light source(s) 40, the type of materials (such as of the primary backing layer 100 and the yarns 11), the arrangement of the yarns 11 and tufts 12, and the irradiance during use, is chosen to prevent substantial escape of light 41 beyond the carpet top face 2. Since light 41 traversing from the light sources 40 is being absorbed by the material(s) met, the intensity of the light 41 decreases with distance from the source 40. In this way, the preferred situation that $I_2/I_{101}<1$, preferably $I_2/I_{101}\approx 0$ may be obtained. This is schematically illustrated with the diagram on the right hand side. Note that the exponential decrease is only an example.

Figure 3:
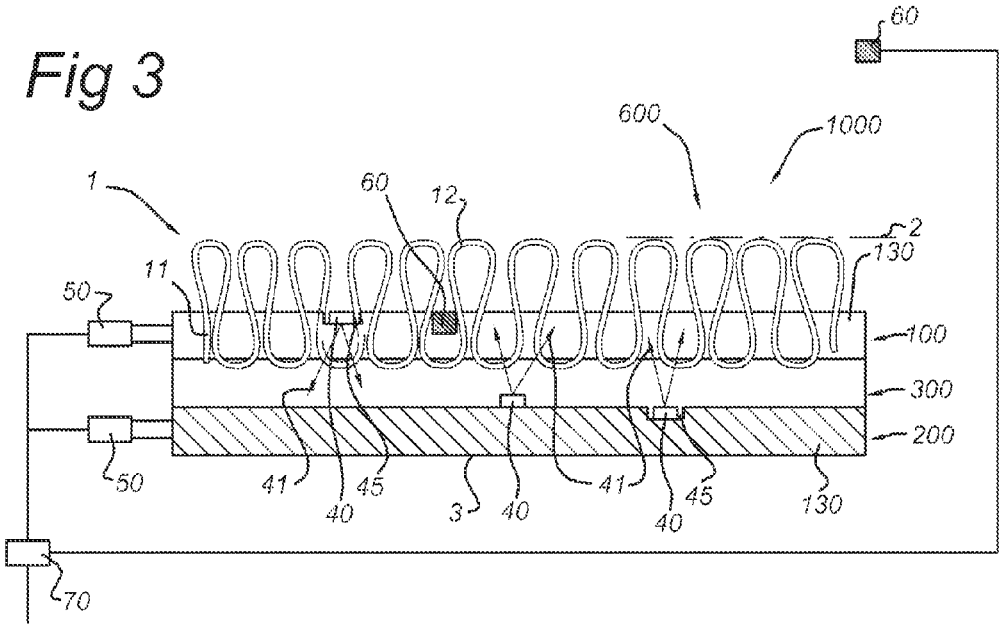
FIG. 3 schematically depicts a light source carpet construction embodiment.

Finally, FIG. 3 schematically depicts an embodiment of the light source carpet construction 1000, further comprising a controller 70 (here arranged external from the carpet 1). The controller 40 may be arranged to control the irradiance of the primary backing layer 100 by the light source 40. The UV irradiance may especially be selected from the range of about 50-10,000 $mW/m^2$. Further, the light source carpet construction 1000 comprises a sensor 60 (here, by way of example an internal and external sensor are schematically depicted), arranged to sense one or more of the presence of a user in a space 600 comprising the tufted carpet 1 and the pressure of a user on the tufted carpet 1. The sensor(s) 60 is arranged to provide a corresponding sensor signal and the controller 70 is arranged to control the irradiance of the primary backing layer 100 by the light source 40 as function of the sensor signal by the sensor 60. For instance the sensor 60 integrated in the carpet 1 may sense a user standing or walking on the carpet 1, thereby providing a signal to the controller 70, which may for instance lower or stop the irradiance of the primary backing layer by the light sources 40.

Preferably, the irradiance, when measured at the carpet surface 2, is in the range of about 5 $mW/m^2$ or less, preferably less than about 0.5 $mW/m^2$. The intensity of the light at the carpet top face 2, indicate as $I_2$ and the intensity of the light at the primary backing layer top face, indicated as $I_{101}$, may be evaluated in a number of ways. Using the irradiances as intensity parameters is one of the options. Hence, in an embodiment, the light source 40 is arranged to provide light with intensity $I_2$ at the carpet top face 2, if measured as irradiance, of about 5 $mW/m^2$ or lower, preferably equal to or lower about 0.5 $mW/m^2$.

The term "substantially" herein, such as in "substantially horizontal" or in "substantially consists", will be understood by the person skilled in the art. The term "substantially" may also include embodiments with "entirely", "completely", "all", etc. Hence, in embodiments the adjective substantially may also be removed. Where applicable, the terms "substantially" or "about" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A carpet for limiting allergens comprising:

a primary backing layer having a top face and a bottom face, and yarns integrated in the primary backing layer with tufts protruding from the top face of the primary backing layer and forming a carpet top; and a plurality of light sources including a first set of one or more light sources positioned in recesses at the top face of the primary backing layer and arranged to direct light having a wavelength in a range of 200-400 nm toward the bottom face of the primary backing layer;

wherein at least some of the yarns and tufts in combination with the arrangement of the light sources prevents at least 90% of the light from the plurality of light sources from traversing beyond the carpet top.

2. The carpet according to claim 1, wherein the first set of one or more light sources and the tufted carpet are laminate.

3. The carpet according to claim 1, wherein the first set of one or more light sources is at least partially integrated in the primary backing layer.

4. The carpet according to claim 1, further comprising a secondary backing layer having a top face and a bottom face, wherein the primary backing layer and the secondary backing layer are laminate, wherein the top face of the secondary backing layer is directed to the bottom face of the primary backing layer.

5. The carpet according to claim 4, further comprising a second set of one or more light sources, wherein the second set of one or more light sources is at least partially integrated in the secondary backing layer.

6. The carpet according to claim 4, further comprising an adhesive layer between the primary and secondary backing layers, wherein the primary backing layer, the adhesive layer, and the secondary backing layer are laminate.

7. The carpet according to claim 6, wherein the second set of one or more light sources is at least partially integrated in the adhesive layer.

8. The carpet according to claim 7, wherein the adhesive layer is at least partially transmissive of the light of the first set of one or more light sources.

9. The carpet according to claim 1, wherein the first set of one or more light sources are configured to generate light having a wavelength selected from the range of 300-400 nm, and 310-350 nm.

10. The carpet according to claim 1, further comprising a controller configured to control irradiance of the primary backing layer by the first set of one or more light sources.

11. The carpet according to claim 10, further comprising a sensor configured to:

provide a signal indicating presence of a user in and on at least one of a space comprising the tufted carpet and the tufted carpet, wherein the irradiance of the primary backing layer by the first set of one or more light sources is controlled in dependence on a function of the signal.

12. The carpet according to claim 1, wherein the one or more light sources are configured to illuminate the primary backing layer with an irradiance in a range of 50-10,000 $mW/m^2$.

13. The carpet according to claim 1, wherein the first set of one or more light sources are configured to provide light with the intensity at the carpet top of irradiance 5 $mW/m^2$ or lower.

14. The carpet according to claim 1, wherein the first set of one or more light sources comprise a UV LED.

15. The carpet according to claim 1, wherein the allergens comprise dust mite allergens and limiting of the allergens is used for prevention of dust mite allergy.

16. A carpet for limiting allergens comprising:

a primary backing layer having a top face and a bottom face, and yarns integrated in the primary backing layer with tufts protruding from the top face of the primary backing layer and forming a carpet top;

a plurality of light sources including a first set of one or more light sources positioned in recesses at the top face of the primary backing layer and configured to direct light having a wavelength in a range of 200-400 nm toward the bottom face of the primary backing layer and to limit the allergens illuminating the primary backing;

a controller configured to control irradiance of the primary backing layer by the first set of one or more light sources;

a sensor configured to provide a signal indicating presence of a user on the tufted carpet:

wherein the irradiance of the primary backing layer by the first set of one or more light sources is reduced when a user is present.

* * * * *